US011259604B2

(12) United States Patent
Kolasa

(10) Patent No.: US 11,259,604 B2
(45) Date of Patent: Mar. 1, 2022

(54) ANTI-PINCH BUCKLE ASSEMBLY

(71) Applicant: ILLINOIS TOOL WORKS INC., Glenview, IL (US)

(72) Inventor: Scott David Kolasa, Mount Prospect, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/459,861

(22) Filed: Jul. 2, 2019

(65) Prior Publication Data

US 2020/0022464 A1 Jan. 23, 2020

Related U.S. Application Data

(60) Provisional application No. 62/702,077, filed on Jul. 23, 2018.

(51) Int. Cl.
*A44B 11/26* (2006.01)
*A44B 11/25* (2006.01)

(52) U.S. Cl.
CPC ..... *A44B 11/266* (2013.01); *A44B 11/2576* (2013.01)

(58) Field of Classification Search
CPC ..... A44B 11/266; A44B 11/2576; A44B 11/2549; A44B 11/2569; A44B 11/2592; Y10T 24/45529; Y10T 24/45581; Y10T 24/4588; Y10T 24/40; Y10T 24/4098
See application file for complete search history.

(56) References Cited

U.S. PATENT DOCUMENTS 4,831,694 A * 5/1989 Kong ..... A44B 11/266 24/606
4,987,662 A * 1/1991 Haffey ..... A44B 11/2576 24/633
5,419,020 A * 5/1995 Murai ..... A44B 11/266 24/625
D396,736 S * 8/1998 Davis ..... D2/639
6,041,480 A * 3/2000 White ..... A44B 11/2576 24/487
6,457,219 B1 * 10/2002 Liu ..... A44B 11/266 24/615
6,463,637 B1 * 10/2002 Carnahan ..... A44B 11/2576 24/578.15

(Continued)

FOREIGN PATENT DOCUMENTS

JP 2008264092 A 11/2008

OTHER PUBLICATIONS

Office Action for counterpart German Patent Application No. 10 2019 119 267.6, dated Feb. 10, 2021 (6 pages).

(Continued)

*Primary Examiner* — Robert Sandy
*Assistant Examiner* — Michael S Lee
(74) *Attorney, Agent, or Firm* — Quarles & Brady LLP

(57) ABSTRACT

A buckle assembly includes a buckle member that is configured to removably connect to a reciprocal buckle member. A retaining guard couples to the buckle member. The retaining guard is configured to reduce a potential of pinching as the buckle member connects to and disconnects from the reciprocal buckle member by providing a barrier where the buckle member and reciprocal buckle member connect.

18 Claims, 12 Drawing Sheets

(56) References Cited

U.S. PATENT DOCUMENTS

| | | | | |
|---|---|---|---|---|
| 6,668,433 | B1 * | 12/2003 | Hood | A44B 11/2576 24/163 R |
| 6,769,157 | B1 * | 8/2004 | Meal | A44B 11/2576 220/284 |
| 6,988,297 | B2 * | 1/2006 | Willard | A44B 11/2576 24/633 |
| 7,302,742 | B2 | 12/2007 | Pontaoe | |
| 8,256,072 | B2 | 9/2012 | Kolasa et al. | |
| 8,925,156 | B2 * | 1/2015 | Zutis | A44B 11/005 24/1 |
| 9,629,410 | B2 * | 4/2017 | Perreault | A42B 3/08 |
| 9,974,365 | B2 * | 5/2018 | Spahn | A44B 11/2546 |
| 2002/0083562 | A1 * | 7/2002 | Lerra | A44B 11/266 24/115 G |
| 2003/0121130 | A1 * | 7/2003 | Buscart | A44B 11/006 24/615 |
| 2008/0115346 | A1 * | 5/2008 | Funo | A44B 11/006 29/700 |
| 2008/0209689 | A1 | 9/2008 | Yang | |
| 2012/0285396 | A1 * | 11/2012 | McCarren | A44B 11/266 119/792 |
| 2014/0075722 | A1 | 3/2014 | Zutis | |
| 2015/0135483 | A1 * | 5/2015 | Grimm | A44B 11/266 24/163 R |
| 2015/0237970 | A1 * | 8/2015 | Baile | A44B 11/001 24/601.7 |
| 2015/0289602 | A1 * | 10/2015 | Crossland | A44B 11/2576 70/14 |
| 2019/0216177 | A1 * | 7/2019 | Bevilacqua | A44B 11/2592 |
| 2019/0335860 | A1 * | 11/2019 | Ying | A44B 11/14 |
| 2020/0107616 | A1 * | 4/2020 | Alley | A43C 11/00 |
| 2020/0163419 | A1 * | 5/2020 | Jing | A01K 27/005 |

OTHER PUBLICATIONS

Search Report and Written Opinion, related French Application No. FR1908336, dated Feb. 24, 2021, 16 pages (machine translation included).

* cited by examiner

ANTI-PINCH BUCKLE ASSEMBLY

RELATED APPLICATIONS

This application claims the benefit of U.S. Provisional Application No. 62/702,077 filed on Jul. 23, 2018, which is hereby incorporated by reference in its entirety.

FIELD OF THE DISCLOSURE

Embodiments of the present disclosure generally relate to buckle assemblies.

BACKGROUND

Buckles are commonly used to connect one strap or component to another strap or component. For example, buckles may be used to fasten components of backpacks, luggage, belts, or the like. U.S. Pat. No. 7,302,742, entitled "Side Release Buckle Assembly," and U.S. Pat. No. 8,256,072, entitled "Buckle," both teach buckle assemblies and are hereby incorporated by reference in their entireties.

Known buckle assemblies commonly include a male buckle member and a female buckle member removably secured to each other. The male buckle member may include lateral arms having buttons integrally formed along lateral sides thereof. The female buckle member may comprise a hollow member having lateral openings configured to retain the buttons of the male buckle member therein. As the male buckle member is inserted into the female buckle member, the lateral arms of the male buckle member inwardly deflect from an original position until the buttons pass into the lateral openings of the female buckle member. At this point, the lateral arms return to the original position, and the buttons are retained within the lateral openings. Therefore, when the male buckle member is secured to the female buckle member, the buttons are exposed through the lateral openings thereof. In order to detach the male buckle member from the female buckle member, the lateral buttons are squeezed together, thereby inwardly deflecting the lateral arms of the male buckle member and allowing the male buckle member to separate from the female buckle member.

However, as the male buckle member is disconnected from the female member, fingers of an individual may be inadvertently pinched between the buttons of the male member and portions of the female member. That is, as the male buckle member is removed from the female buckle member, fingers of an individual may be pinched, caught, or otherwise engaged between portions of the male buckle member and the female buckle member. Additionally, as the male buckle member and female buckle member are connected, fingers, clothing, skin, or other external elements can get caught between the two members.

A known buckle assembly includes a large buckle member that is less susceptible to pinching; however, the buckle member is bulky, large, and costly to mold. Therefore, the component may not be suitable for use with certain applications. Additionally, as another example, buckle members are commonly over-molded with a soft material to prevent or minimize pinching. That is, a separate over-molding process is used to secure a base to the buckle member, thereby providing a guard between the buckles and exterior elements. The over-molding process, however, adds time and cost to the manufacturing process, making this approach undesirable for many applications.

SUMMARY

In one aspect, a buckle assembly includes a buckle member that is configured to removably connect to a reciprocal buckle member. A retaining guard couples to the buckle member. The retaining guard is configured to reduce a potential of pinching as the buckle member connects to and disconnects from the reciprocal buckle member by providing a barrier where the buckle member and reciprocal buckle member connect.

In another aspect, a buckle assembly includes a buckle member that is configured to removably connect to a reciprocal buckle member. The buckle member includes one or more recessed areas, a locking protuberance, openings formed through lateral portions thereof, and one or more pegs. The buckle assembly further includes a retaining guard that is coupled to the buckle member. The retaining guard is configured to reduce a potential of pinching as the buckle member connects to and disconnects from the reciprocal buckle member by providing a barrier where the buckle member and reciprocal buckle member connect.

In another aspect, a buckle assembly includes a buckle member that is configured to removably connect to a reciprocal buckle member. A retaining guard couples to the buckle member and includes a base, a retaining arch extending from the base, a retaining aperture, and one or more securing holes. The retaining guard is configured to reduce a potential of pinching as the buckle member connects to and disconnects from the reciprocal buckle member by providing a barrier where the buckle member and reciprocal buckle member connect.

Figure 1:
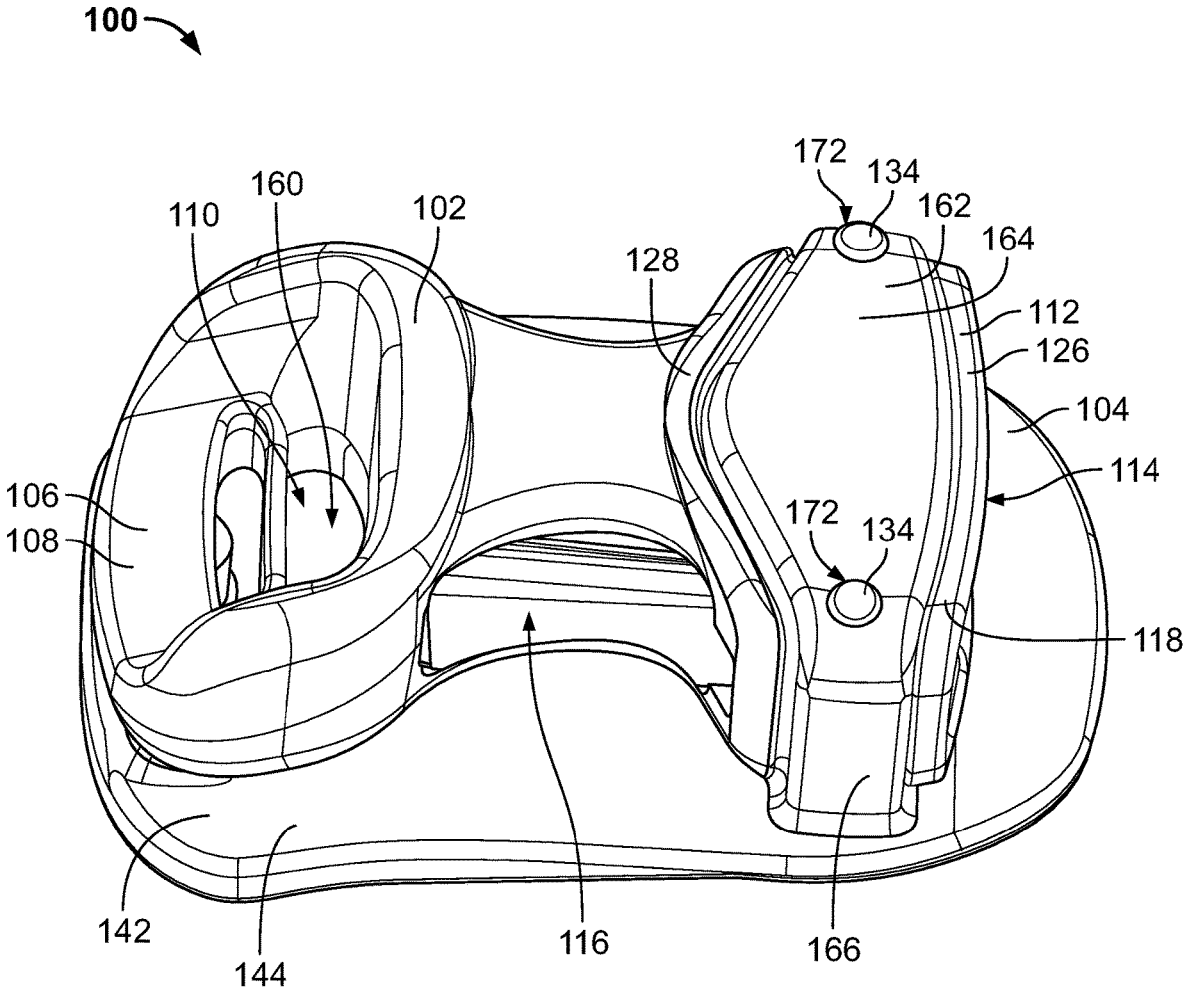
FIG. 1 is a perspective top view of a buckle assembly, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION

Aspects of the present disclosure provide a buckle assembly configured to removably connect to a reciprocal buckle member. Together, the buckle assembly and the reciprocal buckle member may define a connector assembly intended to connect straps or components of articles, such as backpacks, luggage, seatbelts, or similar articles. The buckle assembly includes a retaining guard that couples to a buckle member. The retaining guard eliminates, minimizes, or otherwise reduces a pinching potential as the buckle member connects to and disconnects from the reciprocal buckle member by providing a barrier where the buckle member and reciprocal buckle member connect. The retaining guard is separately molded, and then removably attached to the buckle member, thereby providing a cost-effective and manufacturing-efficient solution to the pinching potential of existing buckles.

Turning now to FIG. 1, a buckle assembly 100 may include a buckle member 102 coupled to a retaining guard 104. In some aspects, the buckle member 102 is a first buckle member designed to mate with a reciprocal second buckle member. More specifically, in the present aspect, the buckle member 102 is a female buckle member configured to mate with a male buckle member. However, it is to be understood that additional aspects may provide a buckle assembly including a buckle member that is a reciprocal second buckle member, such as a female buckle member, configured to mate with a first buckle member, such as a male buckle member. Further, additional aspects may provide a buckle assembly comprising any appropriate type of securing member that is configured to mate with a reciprocal member, such as a latch, a slide bolt, a clip, etc.

Figure 2:
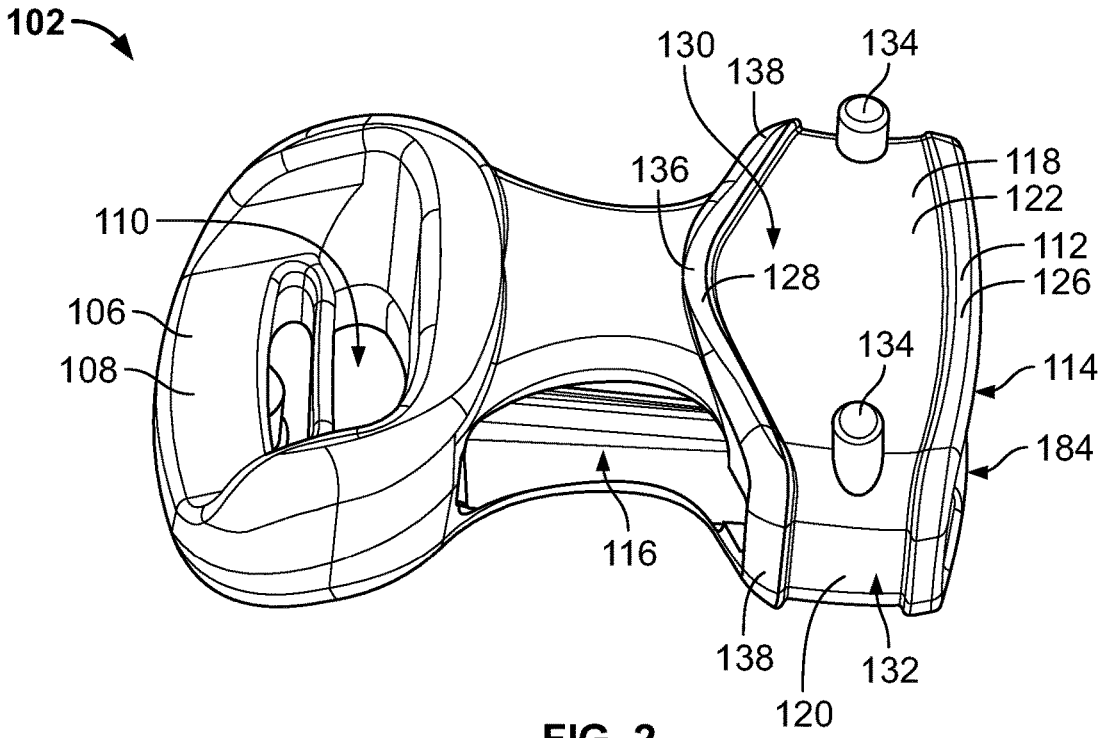
FIG. 2 is a perspective top view of a buckle member of the buckle assembly of FIG. 1.

With reference to FIG. 2, the buckle member 102 may include a first web-retaining end 106 having a first loop bar 108 and a first webbing channel 110. The webbing channel 110 is configured to receive and retain a first portion of webbing, such as a strap of a backpack, luggage, a seatbelt, or any other appropriate component. The buckle member 102 may further include a receiving end 112 opposite from the first web-retaining end 106, which may include an opening 114 that is configured to receive a portion of a reciprocal buckle member, such as a male buckle member or latch. Lateral openings 116 may be formed through lateral portions of the buckle member 102 and configured to retain buttons of the reciprocal buckle member.

A collar 118 may extend around the receiving end 112 of the buckle member 102. The collar 118 may include lateral walls 120 that connect to a top wall 122 and a lower wall 124 (see FIG. 3). An outer rim 126 and an inner rim 128 may extend from the top wall 122 and the lateral walls 120, thereby defining a top recessed area 130 on the top wall 122, and side recessed areas 132 on the lateral walls 120. Further, pegs 134 may extend from the top wall 122. Although the present aspect depicts the pegs 134 positioned within the top recessed area 130 on the top wall 122 and proximate the lateral walls 120, it is to be understood that the pegs 134 may be provided at different locations on the buckle member 102. For example, the pegs 134 may extend from the lateral walls 120 of the collar 118. As a further example, the pegs 134 may extend from the lower wall 124 (see FIG. 3) of the collar 118. Additionally, although the present aspect depicts the buckle member 102 having two pegs 134, additional aspects may include more, fewer, or no pegs 134.

The outer rim 126 on the top wall 122 may bow away from the first web-retaining end 106, whereas the inner rim 128 on the top wall 122 may bow toward the first web-retaining end 106. More specifically, a mid-section 136 of the inner rim 128 on the top wall 122 may inwardly extend toward the first web-retaining end 106 farther than lateral regions 138 of the inner rim 128. However, it is to be understood that the outer rim 126 and the inner rim 128 may be sized and shaped differently than shown. For example, the outer rim 126 and the inner rim 128 on the top wall 122 may be parallel curves. As a further example, one or both of the outer rim 126 and the inner rim 128 on the top wall 122 may be linear.

Figure 3:
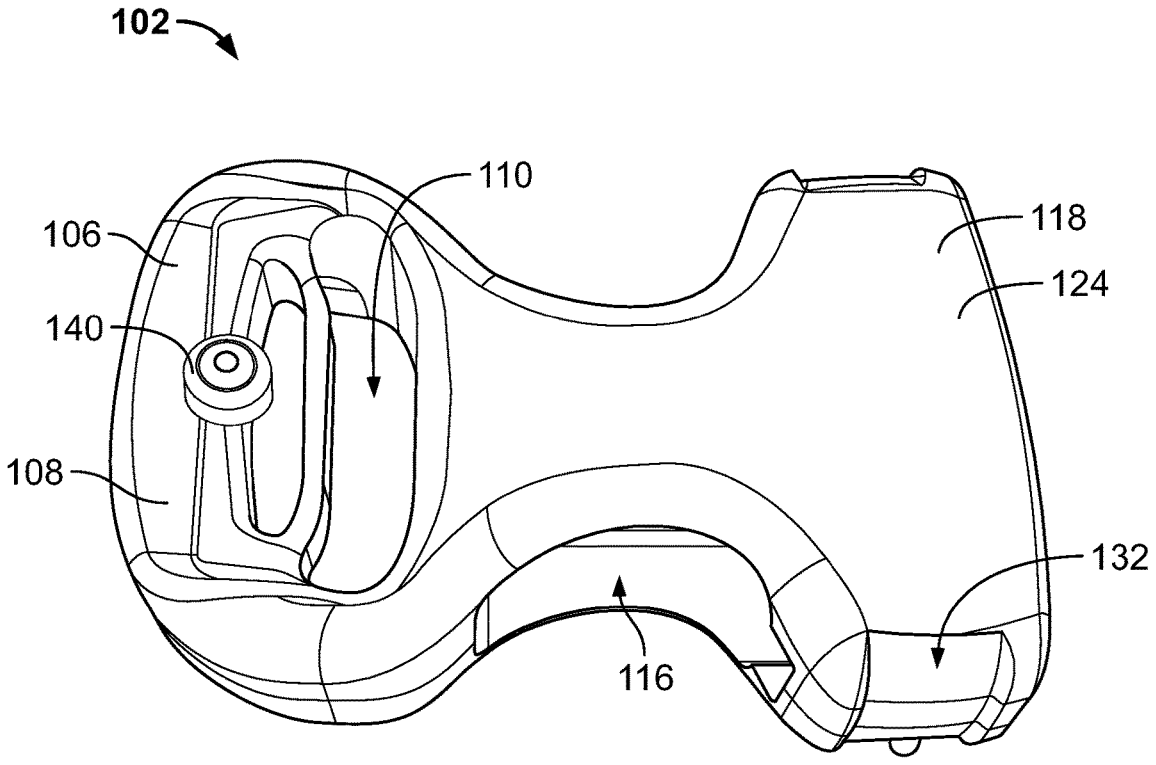
FIG. 3 is a perspective bottom view of the buckle member of FIG. 2.

Turning to FIG. 3, a locking protuberance 140 may downwardly extend from the lower wall 124 of the first loop bar 108. In the present aspect, the locking protuberance 140 is a hollow cylinder intended to be heat staked; however, it is to be understood that the locking protuberance 140 could embody elements of varying sizes and shapes, such as studs, posts, blocks, etc. For example, the locking protuberance 140 may include a supporting post and a head, wherein the head is wider than the supporting post. As another example, the locking protuberance 140 may include a curve or hook. The presence of the curve or hook may require bending or manipulation of the retaining guard 104 in order to receive the locking protuberance 140 in a retaining hole. Although the present aspect includes one locking protuberance 140, it is to be understood that additional aspects may include more or no locking protuberances 140. Further, although the locking protuberance 140 in the present aspect is positioned on the lower wall 124 of the first loop bar 108, additional aspects may provide the locking protuberance 140 at any location on the buckle member 102.

Figure 4:
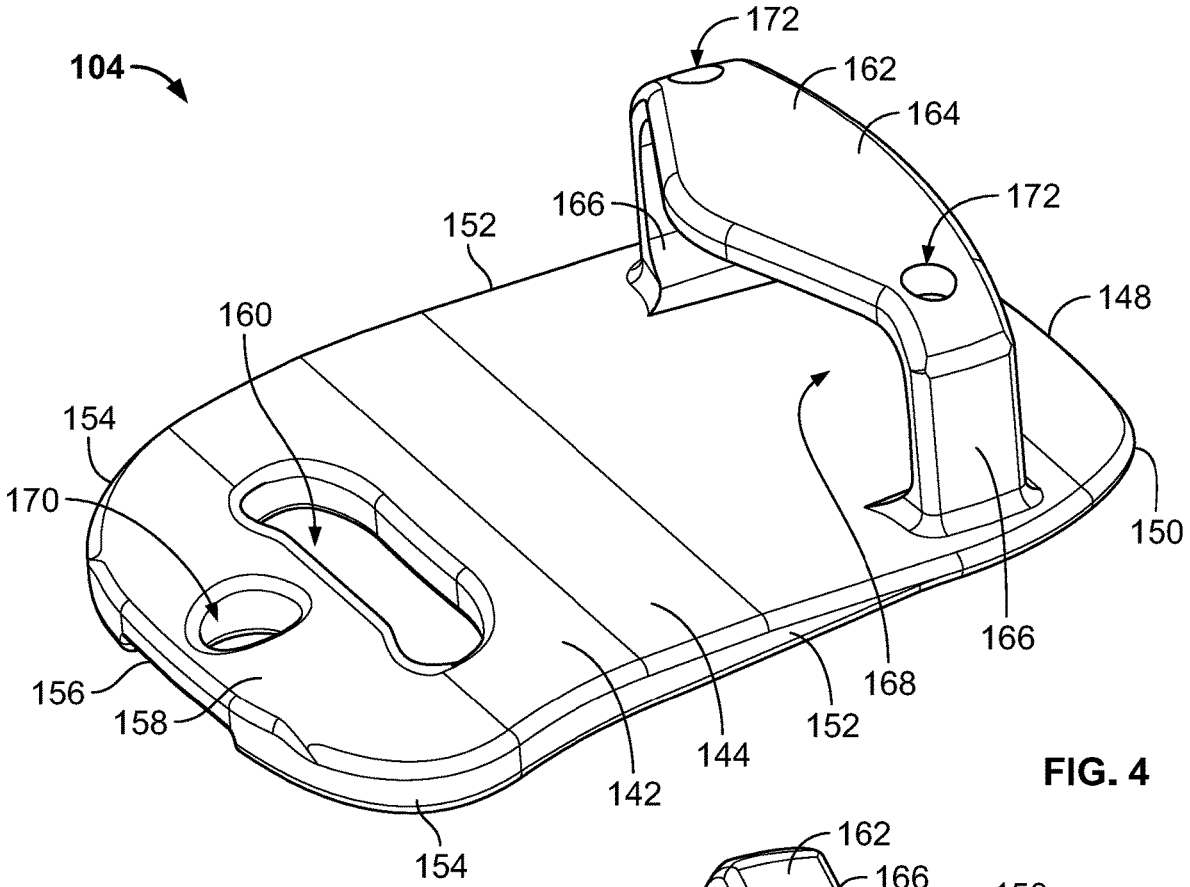
FIG. 4 is a perspective side view of a retaining guard of the buckle assembly of FIG. 1.

With reference to FIG. 4, the retaining guard 104 may include a base 142 that is predominately rectangular; however, other aspects may provide the base 142 of any appropriate shape, such as circular, oval, triangular, hexagonal, etc. The base 142 includes a top surface 144 opposite from a bottom surface 146 (see FIG. 5). Further, the base 142 may include a front edge 148 having front curved lateral corners 150, side edges 152 extending from the curved lateral corners 150 to rear curved lateral corners 154, and a rear edge 156 positioned between the rear curved lateral corners 154.

Still referring to FIG. 4, the base 142 may include a base loop bar 158 and a base webbing channel 160 that are configured to align with the first loop bar 108 and first webbing channel 110 of the buckle member 102 (see FIG. 2), to jointly receive and retain the first portion of webbing. However, it is to be understood that the aforementioned elements are optional. The retaining guard 104 further includes a retaining arch 162 that extends from the top surface 144 of the base 142. The retaining arch 162 may include a crossbeam 164 connected to the top surface 144 of the base 142 by lateral beams 166. Therefore, the retaining arch 162 and the base 142 define a passage 168 therebetween. The lateral beams 166 may be sized and shaped to conform to the shape of the side recessed areas 132 on the lateral walls 120 of the buckle member 102 (see FIG. 2), while the crossbeam 164 may be sized and shaped to conform to the shape of the top recessed area 130 on the top wall 122 of the buckle member 102 (see FIG. 2). In the present aspect, the retaining arch 162 is located closer to the front edge 148 than the rear edge 156; however, the retaining arch 162 may be provided at different locations on the base 142. For example, the retaining arch 162 may be located closer to the rear edge 156 than the front edge 148. As another example, the retaining arch 162 may be equidistant from both the front edge 148 and the rear edge 156.

A retaining aperture 170 may be formed within the base 142 proximate the rear edge 156. The retaining aperture 170 is sized and shaped to receive and retain the locking protuberance 140 of the buckle member 102 (see FIG. 3). In the present aspect, the retaining aperture 170 is circular; however, the retaining aperture 170 may be any appropriate shape, such as square, rectangular, oval, etc. Additionally, it is to be understood that the retaining aperture 170 is an optional element of the present disclosure.

Still referring to FIG. 4, the crossbeam 164 of the retaining arch 162 may define one or more securing holes 172, which may be sized and shaped to receive and retain the pegs 134 of the buckle member 102 (see FIG. 2). Although the present aspect depicts the securing holes 172 positioned on the crossbeam 164 proximate the lateral beams 166, it is to be understood that the securing holes 172 may be provided at different locations on the retaining guard 104. For example, the securing holes 172 may be formed within the lateral beams 166 of the retaining guard 104. As a further example, the securing holes 172 may be formed within the base 142 of the retaining guard 104. Additionally, although the present aspect depicts the retaining guard 104 having two securing holes 172, additional aspects may include more, fewer, or no securing holes 172.

Figure 5:
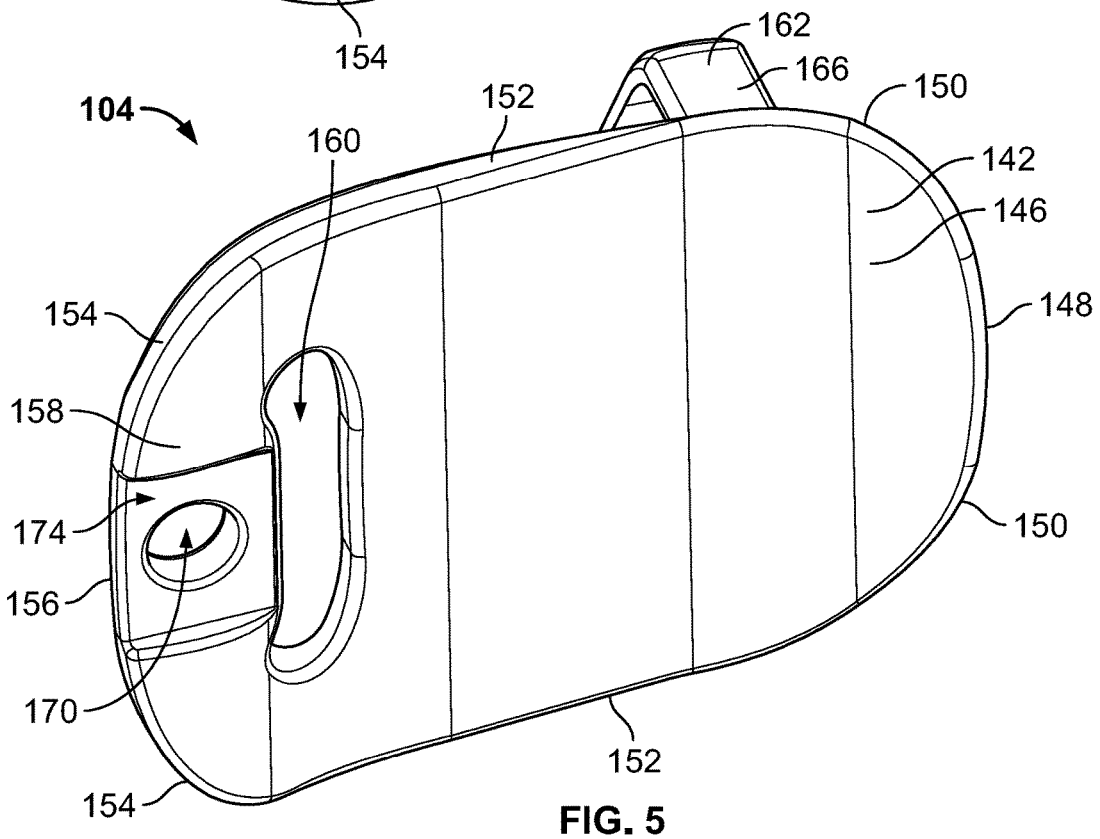
FIG. 5 is a perspective bottom view of the retaining guard of FIG. 4.
Figure 11:
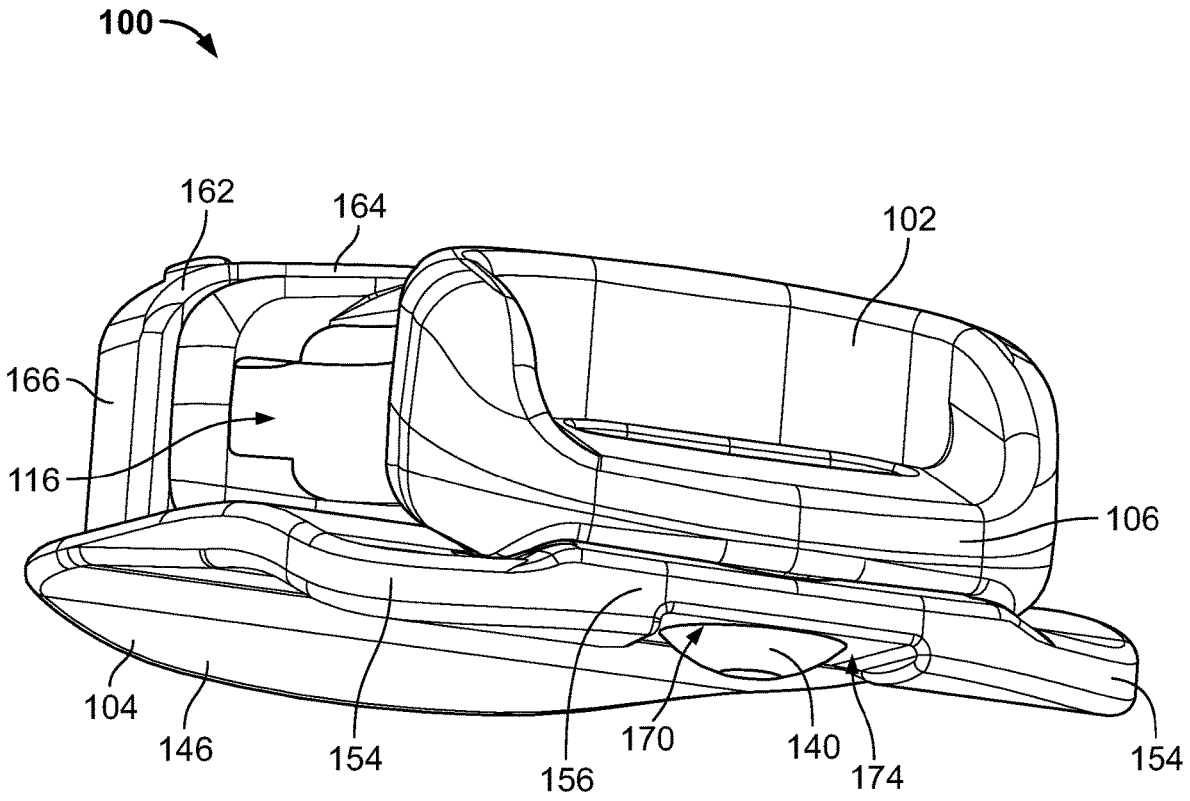
FIG. 11 is a perspective rear view of the buckle assembly of FIG. 1.

Turning to FIG. 5, a recessed region 174 may be provided on the bottom surface 146 of the base 142 surrounding the retaining aperture 170. In the present aspect, the recessed region 174 is predominately rectangular and is positioned on the base loop bar 158; however, the recessed region 174 may be shaped differently, may be provided on different areas of the retaining guard 104, or may not be provided at all. Additionally, the recessed region 174 is a planar surface in the present aspect; however, alternatively, the recessed region 174 may not be planar. The recessed region 174 is provided to reduce or minimize projection of the locking protuberance 140 (see FIG. 3) beyond the bottom surface 146 of the retaining guard 104. More specifically, when the locking protuberance 140 of the buckle member 102 (see FIGS. 9 and 11) is retained within the retaining aperture 170, it is shrouded or otherwise shielded by the recessed region 174, thereby protecting the locking protuberance 140 from being snagged by materials, or contacted by an individual. Thus, an individual may not feel the locking protuberance 140 due to the recessed region 174.

Figure 6:
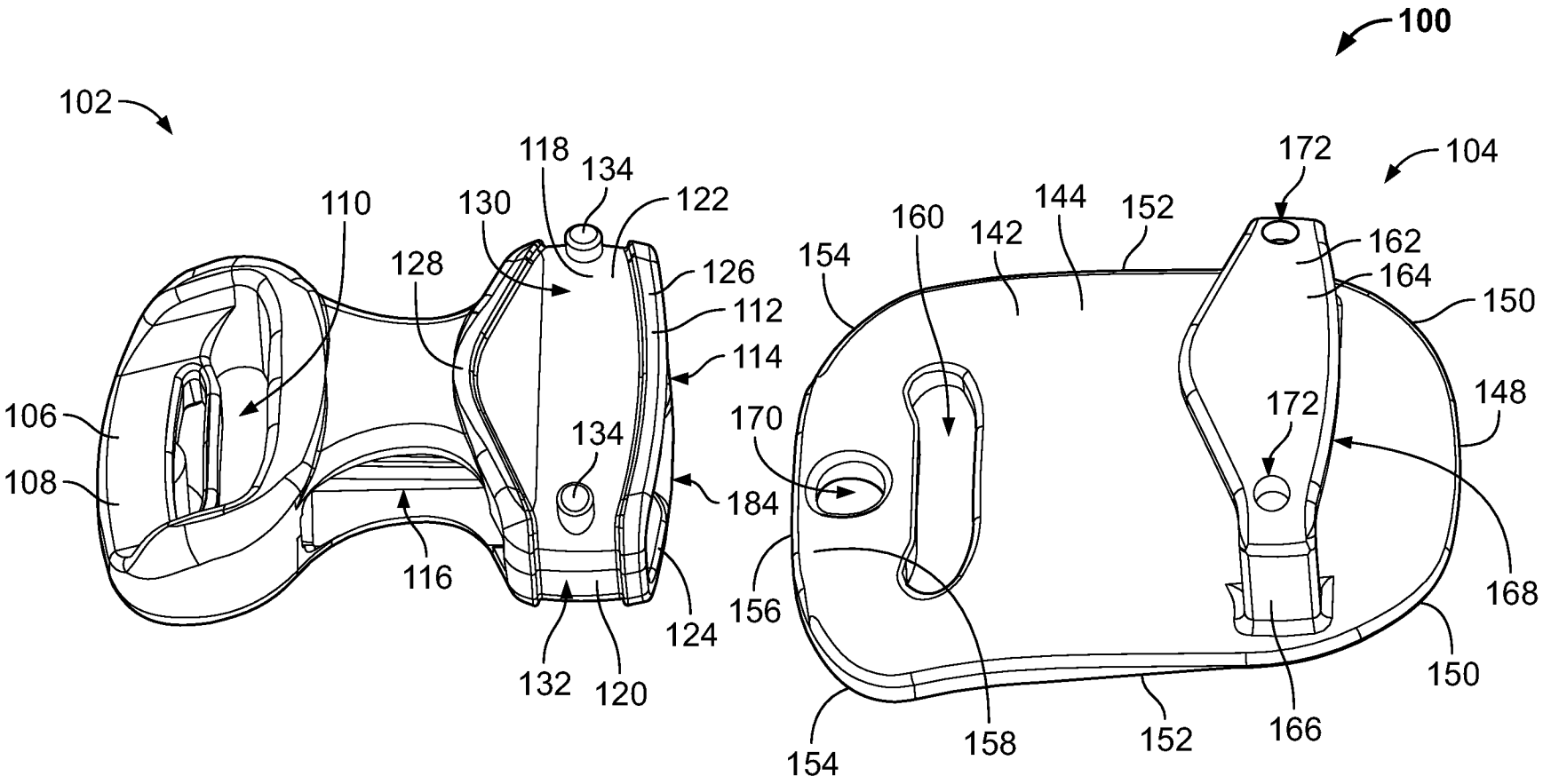
FIG. 6 is an exploded perspective top view of the buckle assembly of FIG. 1.

Turning to FIG. 6, the buckle member 102 and the retaining guard 104 may be formed of different materials having varying degrees of hardness or elasticity. For example, the buckle member 102 may be formed of a first material, while the retaining guard 104 may be formed of a second material that is softer than the first material. More specifically, the buckle member 102 may be formed of a hard plastic, while the retaining guard 104 may be formed of a resilient material, such as an elastomeric material (e.g. rubber), fabric, or the like. In additional aspects, other polymers that form hard plastic and elastomers that form resilient materials may be used.

Still referring to FIG. 6, in order to connect the buckle member 102 to the retaining guard 104, the buckle member 102 is aligned so that the receiving end 112 is positioned toward the retaining arch 162 of the retaining guard 104, and the lower wall 124 of the buckle member 102 is positioned above the top surface 144 of the retaining guard 104. The receiving end 112 of the buckle member 102 is aligned with the passage 168 of the retaining guard 104, and the buckle member 102 and the retaining guard 104 are then urged toward each other.

Figure 7:
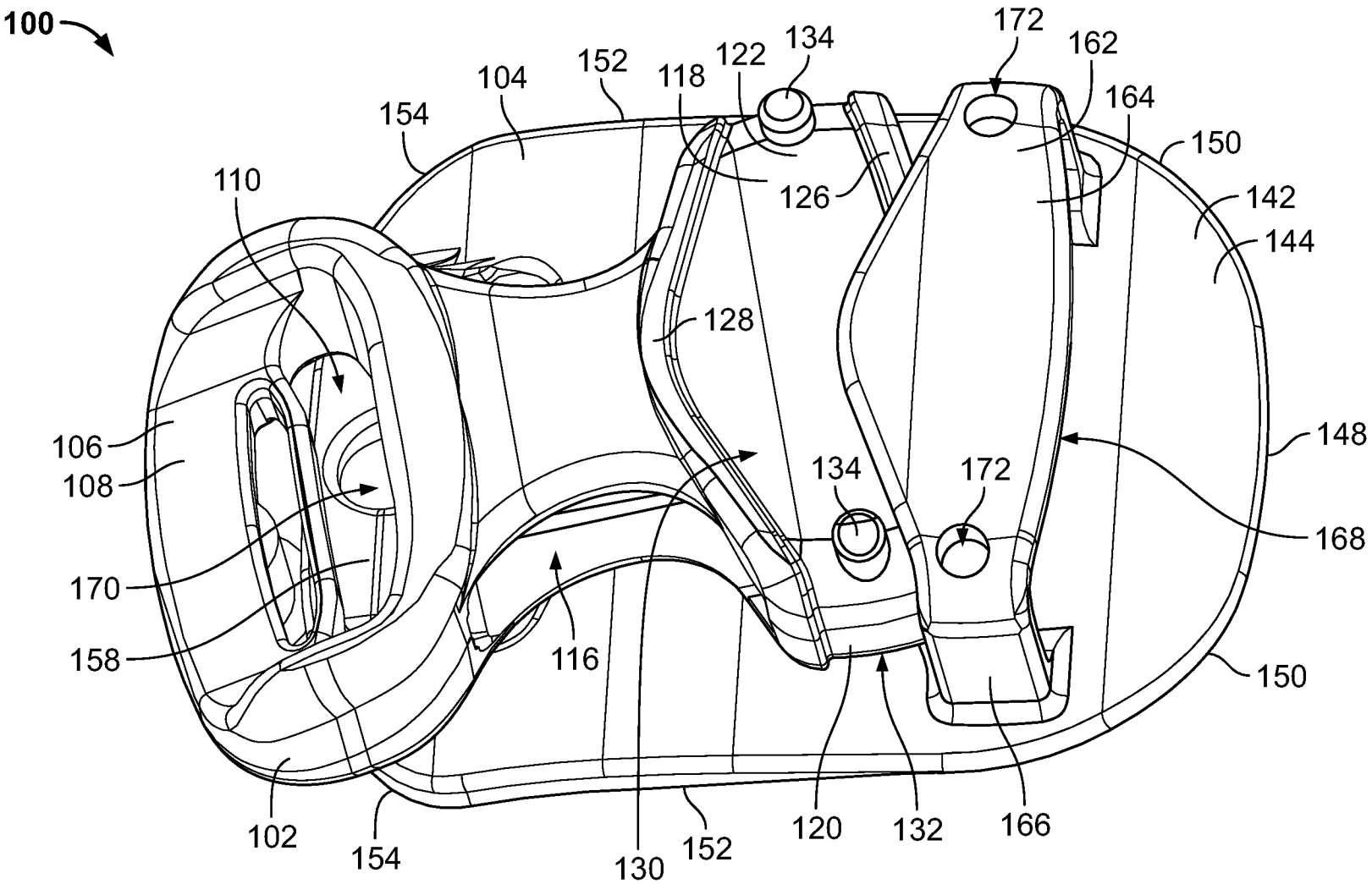
FIG. 7 is another exploded perspective top view of the buckle assembly of FIG. 1.
Figure 8:
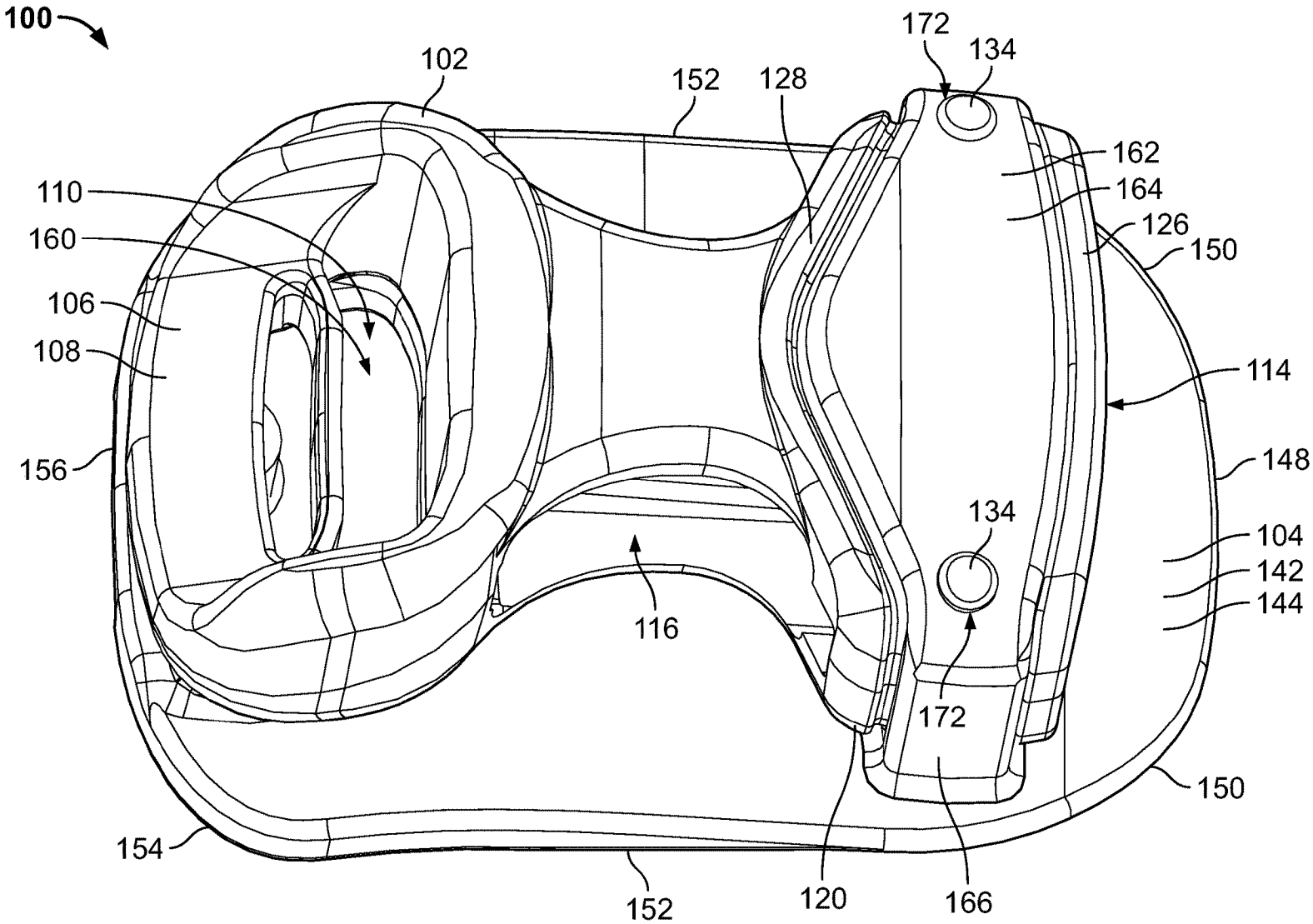
FIG. 8 is a perspective top view of the buckle assembly of FIG. 1.

Turning to FIG. 7, as the buckle member 102 mates with the retaining guard 104, the retaining arch 162 of the retaining guard 104 stretches or otherwise resiliently deflects to pass over the outer rim 126 of the buckle member 102 until it rests inside the recessed areas 130, 132 of the buckle member 102, as illustrated by FIG. 8.

Figure 9:
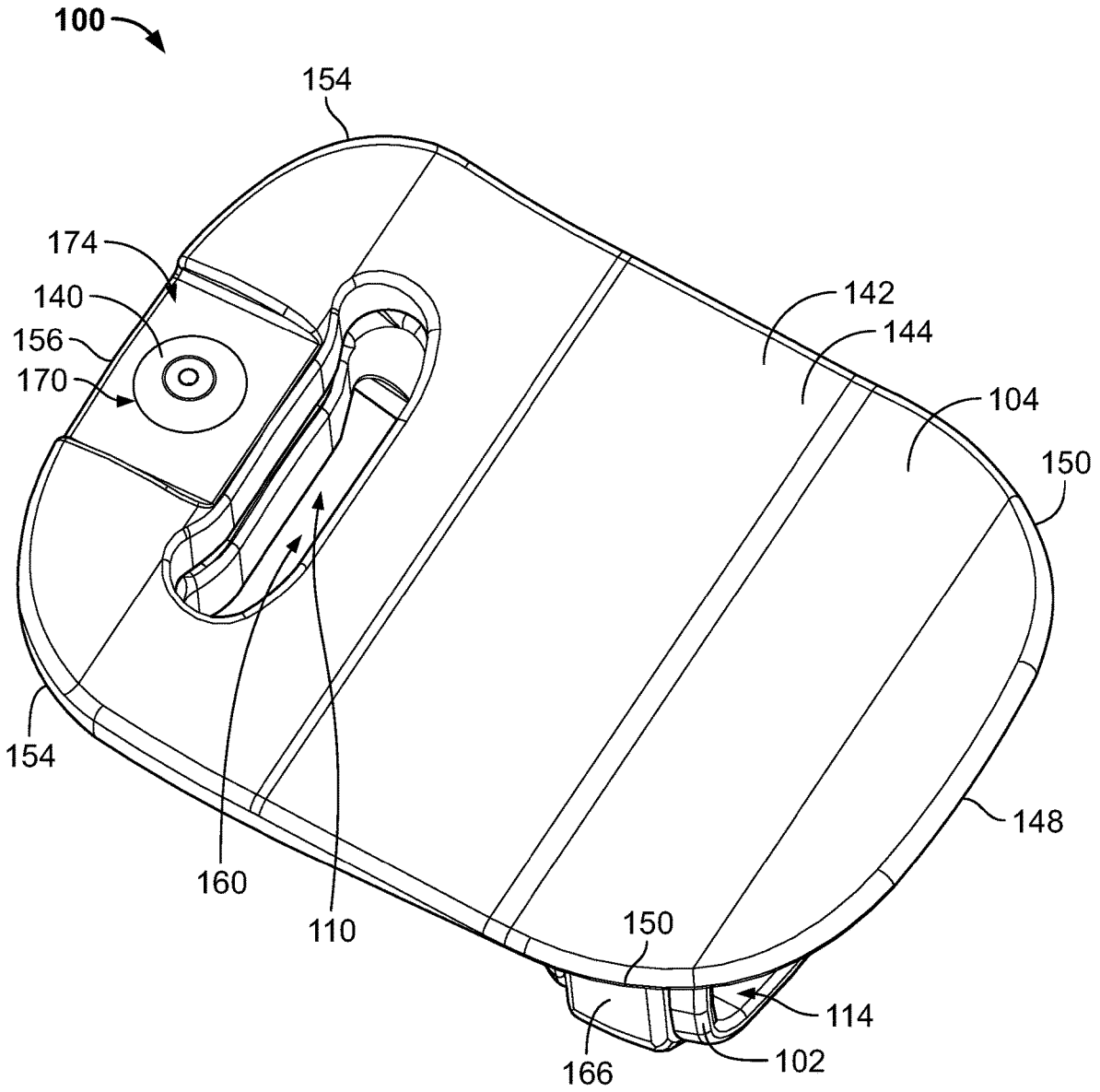
FIG. 9 is a perspective bottom view of the buckle assembly of FIG. 1.

Still referring to FIG. 8, when the buckle assembly 100 is assembled, the pegs 134 are retained by the securing holes 172 of the retaining guard 104. Further, as shown in FIG. 9, the locking protuberance 140 of the buckle member 102 is retained by the retaining aperture 170 of the retaining guard 104. As a result, the buckle member 102 is secured to the retaining guard 104. In the present aspect, to ensure the buckle member 102 remains securely attached to the retaining guard 104, the locking protuberance 140 may be heat staked. As shown in FIG. 8, heat staking deforms the locking protuberance 140 to create an interference fit between the locking protuberance 140 and the retaining aperture 170, which prevents the two components from separating. As previously mentioned, in some aspects, the locking protuberance 140 may alternatively include a wider head, a curve, or a hook. The presence of the curve or hook may require bending or manipulation of the retaining guard 104 in order to receive the locking protuberance 140 in the retaining aperture 170. The additional manipulation may be, for example, but not limited to, an angled insertion. The bending or manipulation to insert the locking protuberance 140 in the retaining aperture 170 may create a more secure connection between the buckle member 102 and the retaining guard 104.

Returning to FIG. 8, the retaining guard 104 may be wider than the width of the buckle member 102. More specifically, in the present aspect, the side edges 152 of the base 142 of the retaining guard 104 laterally extend past the lateral walls 120 of the buckle member 102. These side edges 152 extend outwardly past the openings 114 of the buckle member 102, thereby providing a barrier that protects an individual from being pinched by a reciprocal buckle member connecting to or disconnecting from the buckle member 102. Additionally, the base 142 may be wider than the retaining arch 162 of the retaining guard 104. That is, the side edges 152 of the base 142 of the retaining guard 104 laterally extend past the lateral beams 166 of the retaining arch 162. However, alternatively, the side edges 152 of the base 142 of the retaining guard 104 may be aligned with the lateral beams 166 of the retaining arch 162.

Figure 10:
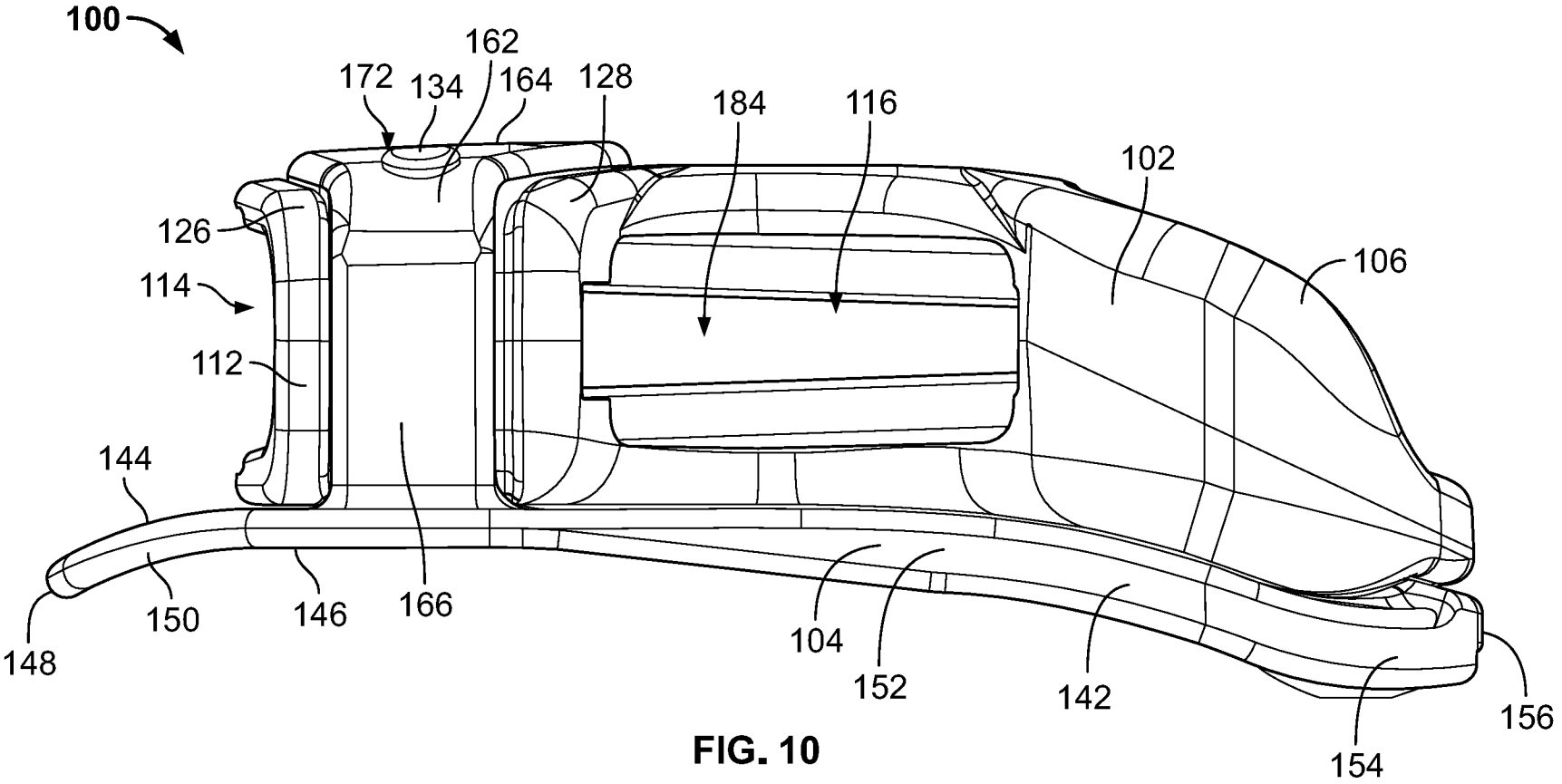
FIG. 10 is a side elevational view of the buckle assembly of FIG. 1.

Now turning to FIG. 10, in the present aspect, a longitudinal length of the base 142 is longer than a longitudinal length of the buckle member 102 and a longitudinal length of the retaining arch 162. However, in additional aspects, the base 142 may be sized equal to or shorter than the longitudinal length of the buckle member 102. Further, the base 142 may be substantially flat; however, the base 142 in the present aspect curves slightly so that the bottom surface 146 is concave.

Figure 12:
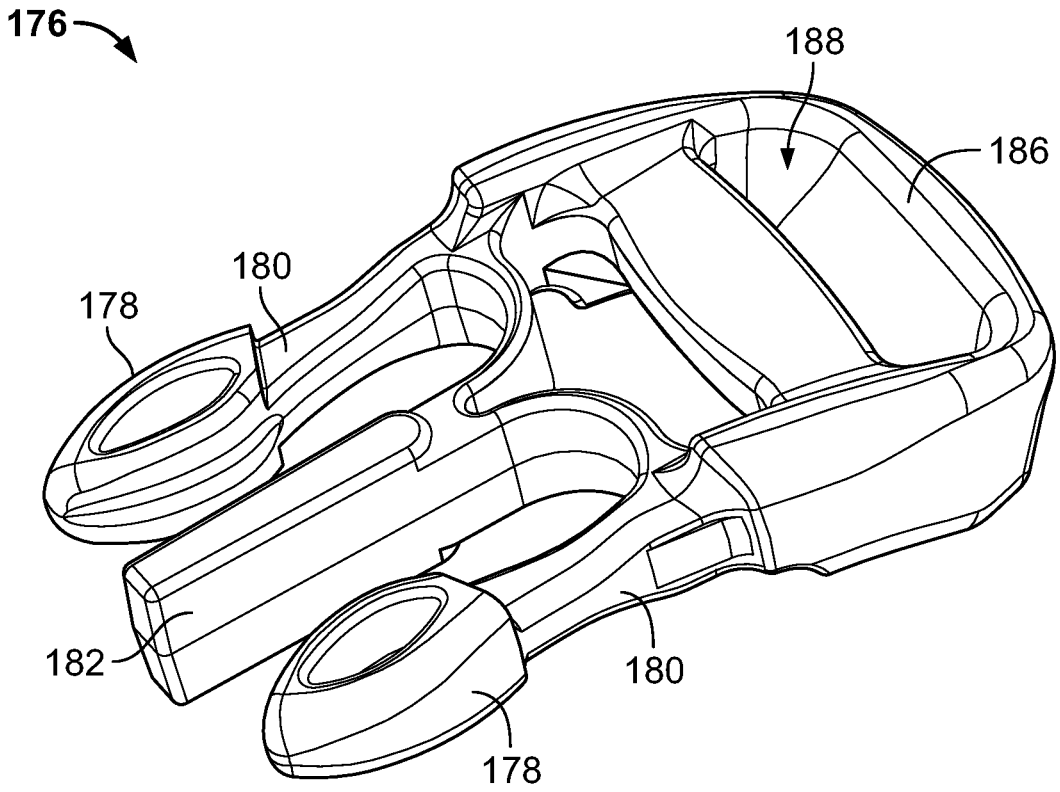
FIG. 12 is a perspective top view of a reciprocal buckle member.

FIG. 12 illustrates one example of a reciprocal buckle member 176 that may connect to the buckle member 102 of FIGS. 1-11, which is a male buckle member, such as shown and described in U.S. Pat. No. 7,302,742; however, it is to be understood that the reciprocal buckle member 176 may be sized and shaped differently than shown. As noted above, the reciprocal buckle member 176 may include a button 178 on a flexible arm 180, which is configured to be retained within the lateral openings 116 of the buckle member 102 (see FIG. 2). In the present aspect, the reciprocal buckle member 176 includes two flexible arms 180; however, additional aspects may provide more or fewer arms 180. Additionally, in some aspects, the reciprocal buckle member 176 includes a guide beam 182 between the arms 180 that is configured to be received and removably retained within a central channel 184 (see FIG. 10) that is formed by the buckle member 102. Further, similar to the buckle member 102 of FIG. 2, the reciprocal buckle member 176 may have a second web-retaining end 186 having a second webbing channel 188 that is configured to receive and retain a second portion of webbing. The second portion of webbing may be a strap of a backpack, luggage, a seatbelt, or any other appropriate component. Moreover, it is to be understood that the reciprocal buckle member 176 may include more or fewer components than shown.

Figure 13:
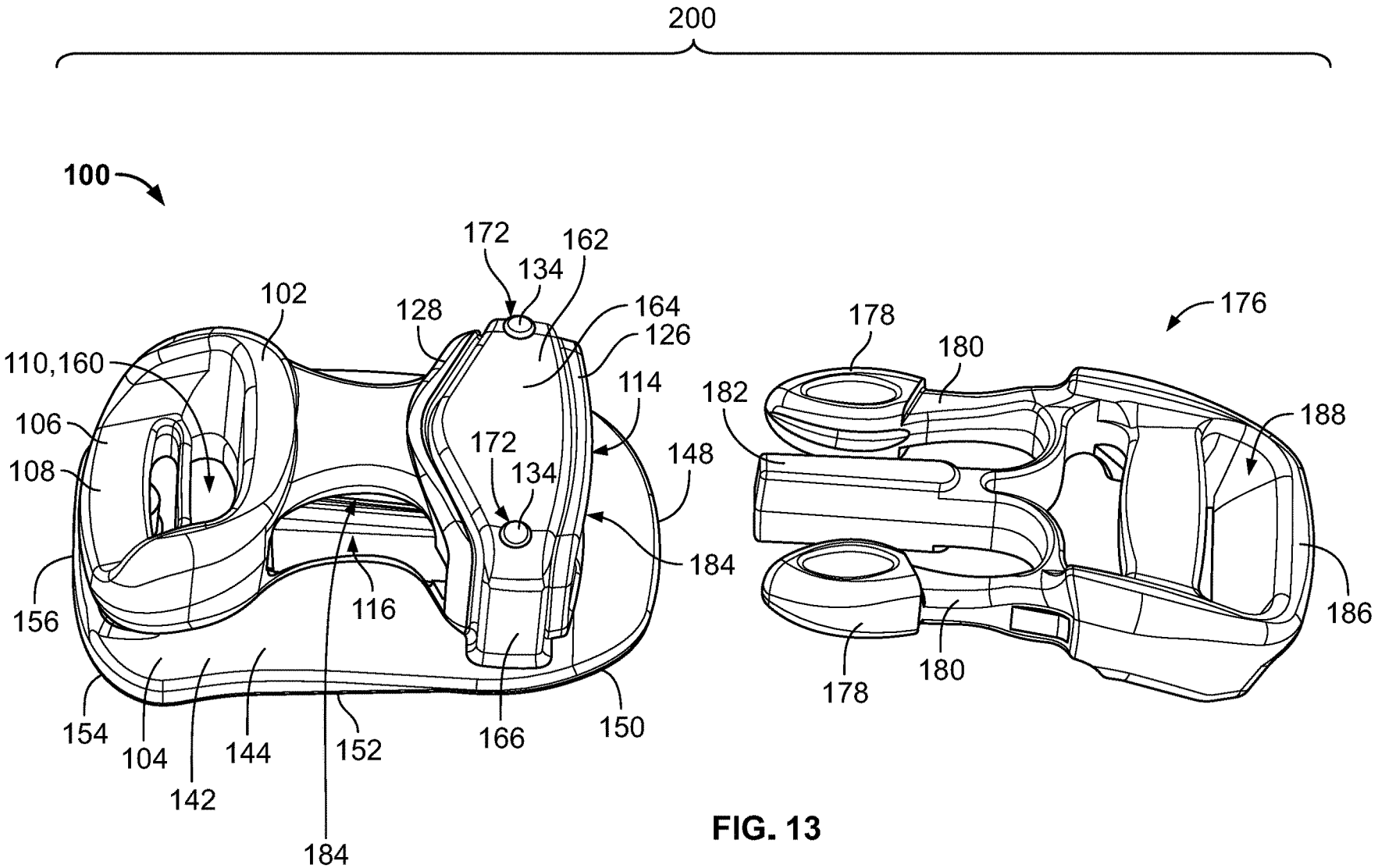
FIG. 13 is an exploded perspective top view of a connector assembly, including the buckle assembly of FIG. 1 and the reciprocal buckle member of FIG. 12.
Figure 14:
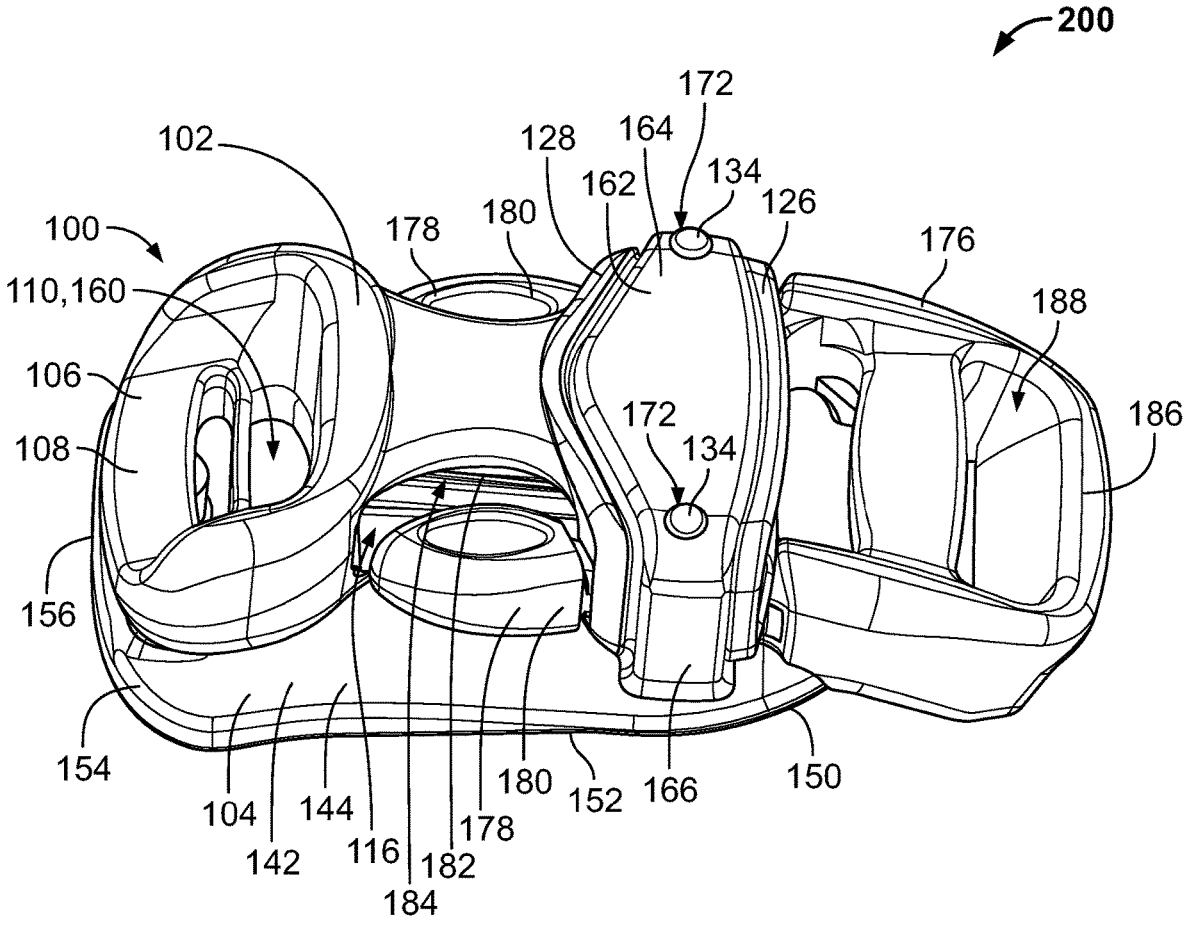
FIG. 14 is a perspective top view of the connector assembly of FIG. 13.

Referring to FIG. 13, a connector assembly 200 comprises the buckle assembly 100 and the reciprocal buckle member 176. As the reciprocal buckle member 176 is connected to the buckle member 102, the lateral arms 180 of the reciprocal buckle member 176 deflect inwardly from an original position until the buttons 178 pass into the lateral openings 116 of the buckle member 102. At this point, the lateral arms 180 return to the original position, and the buttons 178 are retained within the lateral openings 116. Additionally, in some aspects, the guide beam 182 is received by the central channel 184 of the buckle member 102. Therefore, as shown in FIG. 14, when the reciprocal buckle member 176 is secured to the buckle assembly 100, the buttons 178 are exposed through the lateral openings 116 in the buckle member 102. In order to disconnect the reciprocal buckle member 176 from the buckle member 102, the buttons 178 are squeezed inwardly together, thereby deflecting the lateral arms 180 of the reciprocal buckle member 176 inwardly and allowing the reciprocal buckle member 176 to separate from the buckle member 102.

The buckle assembly 100 is configured to eliminate, minimize, or otherwise reduce a potential of pinching fingers of an individual, such as when the buckle assembly 100 is connected to and disconnected from the reciprocal buckle member 176 or another component, such as a latch, by providing a barrier where the two components connect. More specifically, because the side edges 152 of the base 142 of the retaining guard 104 laterally extend past the lateral walls 120 of the buckle member 102, when the reciprocal buckle member 176 detaches from the buckle member 102, the base 142 protects skin, clothing, hair, and other materials from being caught between the buttons 178 of the reciprocal buckle member 176 and portions the buckle member 102 around the openings 114 thereof. Further, because the base 142 of the retaining guard 104 is longer than the longitudinal length of the buckle member 102, as the reciprocal buckle member 176 attaches to the buckle member 102, skin, clothing, hair, and other materials are protected from being pinched or otherwise caught between the reciprocal buckle member 176 and the collar 118 of the buckle member 102.

The buckle assembly 100 also provides reduced manufacturing costs and efficient assembly processes. More specifically, because the retaining guard 104 is formed of a different material than the buckle member 102, the buckle assembly 100 does not require a costly over-molding operation. Further, the top and side recessed areas 130, 132 of the buckle member 102 allow for the retaining guard 104 to be easily slipped onto the buckle member 102 and secured in place, which may simplify assembly and reduce manufacturing costs.

As described herein, aspects of the present disclosure provide a buckle assembly that prevents, minimizes, or otherwise reduces a potential for pinching during connection and disconnection with another buckle member. Further, aspects of the present disclosure provide a buckle assembly having a compact profile, and which may be efficiently and cost-effectively manufactured.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The claims are to be construed to include alternative embodiments to the extent permitted by the prior art.

To the extent used in the appended claims, the terms "including" and "in which" are used as the plain-English equivalents of the respective terms "comprising" and "wherein." Moreover, to the extent used in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Various features of the disclosure are set forth in the following claims.

I claim:

1. A buckle assembly, comprising:

a buckle member configured to removably connect to a reciprocal buckle member, the buckle member comprising one or more pegs extending from a surface, and a collar defining an opening configured to receive the reciprocal buckle member; and a retaining guard that couples to the buckle member, the retaining guard comprising a base and a retaining arch that together define a passage for receiving and retaining the collar of the buckle member, a longitudinal length of the base being greater than a longitudinal length of the retaining arch, wherein the retaining guard is configured to reduce a potential of pinching as the buckle member connects to and disconnects from the reciprocal buckle member by providing a barrier where the buckle member and reciprocal buckle member connect, wherein the longitudinal lengths are measured in the direction that the reciprocal buckle member is received by the opening, wherein the retaining arch comprises lateral beams extending from the base and connected to a crossbeam, wherein the passage is defined between the base, the lateral beams, and the crossbeam, and wherein the buckle member comprises a locking protuberance that is retained within a retaining aperture of the retaining guard.

2. The buckle assembly of claim 1, wherein the buckle member comprises at least one opening formed through a lateral portion, wherein the at least one opening is configured to receive and retain at least one button of the reciprocal buckle member.

3. The buckle assembly of claim 2, wherein the retaining guard is configured to reduce a potential of pinching as the buckle member connects to and disconnects from the reciprocal buckle member by providing a barrier adjacent the at least one opening of the lateral portion.

4. The buckle assembly of claim 1, wherein the buckle member comprises one or more recessed areas that are configured to retain one or more portions of the retaining guard.

5. The buckle assembly of claim 4, wherein the one or more recessed areas of the buckle member comprise a top recessed area on a top wall, and side recessed areas on lateral walls extending from the top wall.

6. The buckle assembly of claim 1, wherein the longitudinal length of the base of the retaining guard is longer than a longitudinal length of the buckle member.

7. The buckle assembly of claim 1, wherein the crossbeam defines one or more securing holes configured to receive the one or more pegs extending from the buckle member.

8. The buckle assembly of claim 1, wherein a retaining aperture is formed through the base of the retaining guard, and receives and retains a locking protuberance of the buckle member.

9. The buckle assembly of claim 1, wherein the one or more pegs are retained within one or more securing holes of the retaining guard.

10. The buckle assembly of claim 1, wherein the buckle member is formed of a first material and the retaining guard is formed of a second material that differs from the first material.

11. The buckle assembly of claim 10, wherein the second material is softer than the first material.

12. A buckle assembly, comprising:

a buckle member configured to removably connect to a reciprocal buckle member and comprising a first opening, a second opening, a third opening, and a recessed area, the first and second openings being laterally opposed, and the third opening being configured to receive the reciprocal buckle member; and a retaining guard comprising a base and a retaining arch that define a passage for receiving and retaining the buckle member, the retaining arch being sized and shaped to at least partially conform to a shape of the recessed area of the buckle member, wherein the retaining guard is configured to couple to the buckle member so that the retaining arch is at least partially retained within the recessed area, and wherein the retaining guard is configured to reduce a potential of pinching as the buckle member connects to and disconnects from the reciprocal buckle member by providing a barrier where the buckle member and reciprocal buckle member connect.

13. The buckle assembly of claim 12, wherein the buckle member further comprises lateral walls that connect to a top wall and a lower wall, and an outer rim and an inner rim that extend from the top wall and lateral walls of the buckle member, thereby defining the recessed area therebetween.

14. The buckle assembly of claim 13, wherein the base of the retaining guard laterally extends beyond the lateral walls of the buckle member when the retaining guard and buckle member are coupled.

15. A buckle assembly, comprising:

a buckle member configured to removably connect to a reciprocal buckle member, the buckle member comprising lateral walls that connect to a top wall and a lower wall; and a retaining guard that couples to the buckle member and comprises a base and a retaining arch extending from the base, the retaining arch and the base together defining a passage for receiving and retaining the buckle member, wherein the retaining guard further includes a retaining aperture, and the buckle member further includes a locking protuberance, the retaining aperture being configured to receive and retain the locking protuberance, wherein the base of the retaining guard is longer than a longitudinal length of the buckle member and laterally extends beyond the lateral walls of the buckle member when the retaining guard and buckle member are coupled, and wherein the retaining guard is configured to reduce a potential of pinching as the buckle member connects to and disconnects from the reciprocal buckle member by providing a barrier where the buckle member and reciprocal buckle member connect.

16. The buckle assembly of claim 15, wherein the retaining arch comprises lateral beams extending from the base and connected to a crossbeam, wherein the passage is defined between the base, the lateral beams, and the crossbeam.

17. The buckle assembly of claim 15, wherein the retaining aperture is defined by the base of the retaining guard.

18. The buckle assembly of claim 15, wherein the retaining guard further includes one or more securing holes that are defined within the retaining arch of the retaining guard, and the buckle member further includes one or more pegs, and wherein the one or more securing holes are configured to receive and retain the pegs of the buckle member.

* * * * *